US008333134B1

(12) United States Patent
Duffy

(10) Patent No.: US 8,333,134 B1
(45) Date of Patent: Dec. 18, 2012

(54) NUT DRIVER WITH NUT SELECTING CAPABILITY

(76) Inventor: Eugene P. Duffy, Klamath Falls, OR (US)

( * ) Notice: Subject to any disclaimer, the term of this patent is extended or adjusted under 35 U.S.C. 154(b) by 259 days.

(21) Appl. No.: 12/969,126

(22) Filed: Dec. 15, 2010

(51) Int. Cl.
*B25B 13/06* (2006.01)
*B25B 23/16* (2006.01)

(52) U.S. Cl. ..... 81/121.1; 81/177.1; 81/DIG. 5

(58) Field of Classification Search ..... 81/121.1, 81/177.1, 119, 124.2, 124.4, 488, DIG. 5
See application file for complete search history.

(56) References Cited

U.S. PATENT DOCUMENTS 4,936,170 A 6/1990 Zumeta
4,969,231 A 11/1990 Mader et al.
4,982,627 A 1/1991 Johnson
5,031,488 A 7/1991 Zumeta
6,477,923 B2 11/2002 Amis
6,792,831 B2 9/2004 Crosser
7,117,765 B1 * 10/2006 Wallden ..... 81/60
D592,922 S * 5/2009 Davidson ..... D8/29
2001/0010833 A1 8/2001 Ray et al.

* cited by examiner

*Primary Examiner* — David B Thomas
(74) *Attorney, Agent, or Firm* — Jerry Haynes Law

(57) ABSTRACT

A nut driver includes a nut driver handle; a nut driver shank extending from the nut driver handle; a nut driver socket having a socket opening on the nut driver shank; at least a portion of at least one of the nut driver handle, the nut driver shank and the nut driver socket having one of a plurality of colors; and a plurality of colored nut selection strips having a plurality of lengths, respectively, on the nut driver shank. One of the nut selection strips has the same color as at least a portion of at least one of the nut driver handle, the nut driver shank and the nut driver socket. The plurality of lengths, respectively, of the plurality of colored nut selection strips corresponds to a plurality of nut sizes, respectively.

20 Claims, 6 Drawing Sheets

NUT DRIVER WITH NUT SELECTING CAPABILITY

FIELD OF THE INVENTION

The disclosure generally relates to nut driver tools. More particularly, the disclosure relates to a nut driver which facilitates matching of a nut driver having a selected size with a nut of corresponding size using color-coded strips on the nut driver.

BACKGROUND OF THE INVENTION

Conventional nut drivers include a handle, a shank extending from the handle and a nut-receiving socket on the shank. The nut driver is typically used to thread and tighten a nut on a bolt by inserting the nut in the socket and rotating the socket against the end of a threaded shank of a bolt to initially thread and then tighten the nut on the bolt shank. Alternatively, the nut driver may be used to hold the nut in place as a wrench or the like is used to drive a bolt through the nut. The handle of the nut driver may be color-coded to aid in the selection of a nut having a size which corresponds to the size of the nut driver socket. For example, a standard or conventional color-coding scheme for a set of nut drivers each having a shank length of 3 inches includes nut drivers having a black handle, a red handle, a yellow handle, a green handle, a blue handle, a brown handle and a red handle, respectively. The sockets of the nut drivers are sized to receive nuts having widths of 3/16, 1/4, 5/16, 11/32", 3/8", 7/16" and 1/2, respectively. Therefore, in the event that a nut having a width of 3/16" is necessary for a particular application, a socket driver having a black handle is selected to thread and tighten the nut on a bolt. A separate color-coding scheme for a set of nut drivers with socket sizes expressed in metric units is available.

One of the limitations of the conventional color-coded handle scheme for matching a nut driver having a particular size with a nut of corresponding size is that the nuts with which the nut drivers are matched are not color-coded. This may necessitate much trial-and-error the event that a mixture of nuts having various sizes is available and each nut must be individually and randomly placed in the socket of a particular nut driver to determine whether the nut fits the nut driver. Before servicing or repairing major appliances such as ranges, washers, and dryers, the rear hack cover plates of such appliances must be removed. Typically, two, three or more different size drivers are required to remove such back cover plates. Thus, a need remains for an improved driver that can be easily positioned on exposed bold head to help select the correct size driver. Accordingly, it is a principle objective of this invention to provide such a driver.

SUMMARY OF THE INVENTION

The disclosure is generally directed to a out driver which facilitates matching of a nut driver having a selected size with a nut of corresponding size using color-coded strips on the nut driver. An illustrative embodiment of the nut driver includes a nut driver handle; a out driver shank extending from the nut driver handle; a nut driver socket having a socket opening on the nut driver shank; at least a portion of at least one of the nut driver handle, the not driver shank and the nut driver socket having one of a plurality of colors; and a plurality of colored nut selection strips having a plurality of lengths, respectively, on the nut driver shank. One of the nut selection strips has the same color as at least a portion of at least one of the nut driver handle, the nut driver shank and the nut driver socket. The plurality of lengths, respectively, of the plurality of colored nut selection strips corresponds to a plurality of nut sizes, respectively.

The disclosure is further generally directed to a nut driver set. An illustrative embodiment of the nut driver set includes a plurality of nut drivers each including a nut driver handle; a nut driver shank extending from the nut driver handle; a nut driver socket having a socket opening on the nut driver shank; at least a portion of at least one of the nut driver handle, the nut driver shank and the nut driver socket having one of a plurality of colors, respectively, corresponding to the plurality nut drivers, respectively; and a plurality of colored nut selection strips having a plurality of lengths, respectively, on the nut driver shank, one of the nut selection strips having the same color as the at least a portion of at least one of the nut driver handle, the nut driver shank and the nut driver socket. The plurality of lengths, respectively, of the plurality of colored nut selection strips corresponds to a plurality of nut sizes, respectively. One of a plurality of colors of at least a portion of at least one of the nut driver handle, the nut driver shank and the nut driver socket corresponds to a plurality of colors of the plurality of colored nut selection strips, respectively.

The disclosure is further generally directed to a method of matching a nut with a nut driver having a corresponding size. An illustrative embodiment of the method includes providing a nut driver including a color-coded nut driver handle, a nut driver shank extending from the nut driver handle, a nut socket on the nut driver shank and color-coded nut selection strips of various lengths on the nut driver shank; selecting a nut; placing the selected nut on the nut driver shank of the nut driver against the nut selection strips; and rotating the nut driver shank of the nut driver until the length of one of the nut selection strips matches a width of the selected nut.

BRIEF DESCRIPTION OF THE DRAWINGS

The disclosure will now be made, by way of example, with reference to the accompanying drawings, in which.

DETAILED DESCRIPTION

Figure 1:
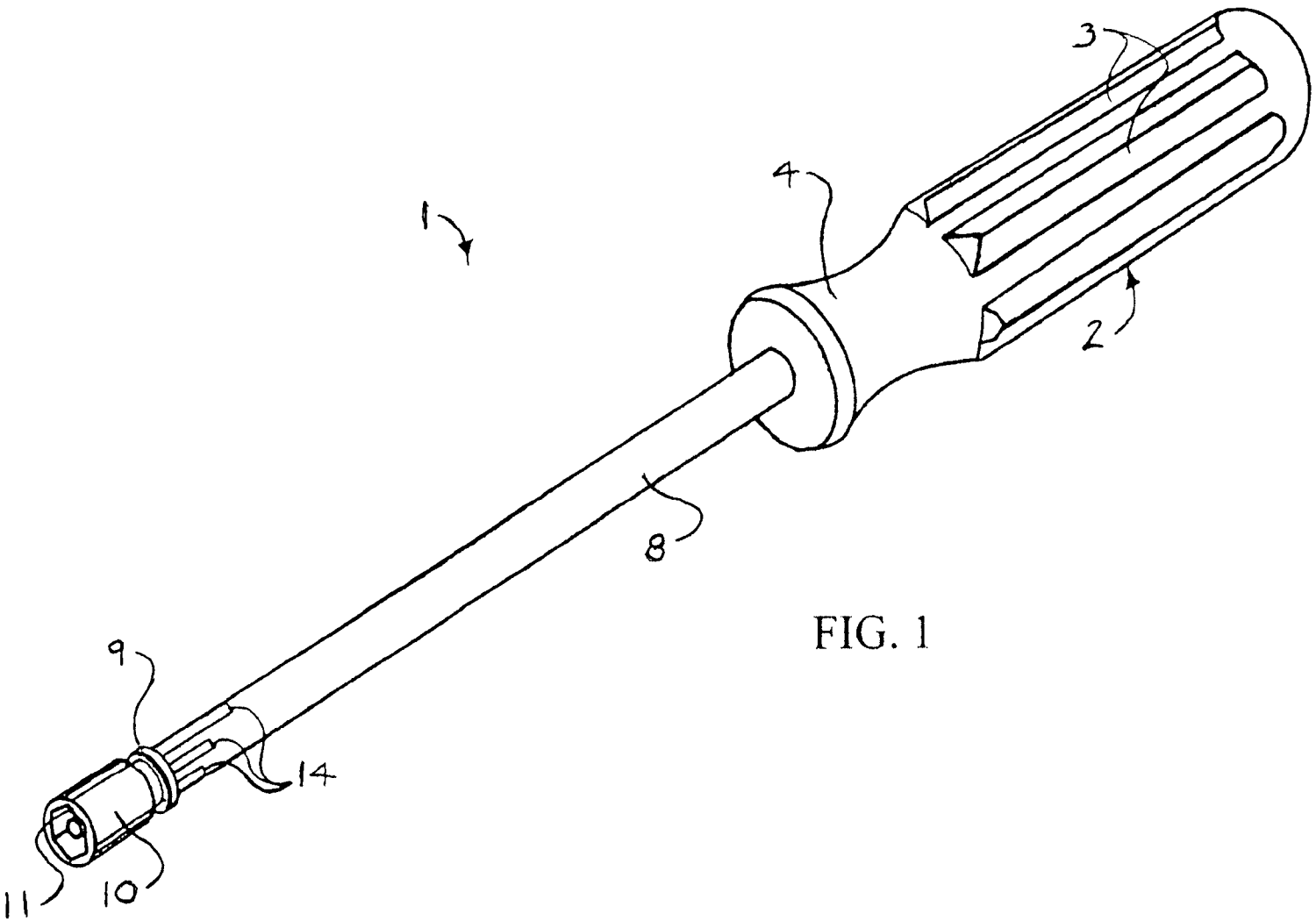
FIG. 1 is a perspective view of an illustrative embodiment of the nut driver with nut selecting capability.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied there presented in the preceding technical field, background, brief summary or the following detailed description. Relative terms such as "upper" and "lower" herein are used with reference to relative positions of various elements with respect to each other in exemplary application of the orthotic joint stabilizing assembly and are not intended to be used in a limiting sense.

Referring initially to FIGS. 1-5 of the drawings, an illustrative embodiment of the nut driver with nut selecting capability, hereinafter nut driver, is generally indicated by reference numeral 1. The nut driver 1 may include a nut driver handle 2. Multiple parallel, elongated, spaced-apart, longitudinal handle grip ridges 3 may protrude from the nut driver handle 2. An annular finger recess 4 may be provided in a front end portion of the nut driver handle 2.

An elongated nut driver shank 8 may extend from the nut driver handle 2. A nut driver socket 10 having a socket opening 11 may terminate the extending or distal end of the nut driver shank 8. In some embodiments, the socket opening 11 of the nut driver socket 10 may be a standard hexagonal shape which is configured to receive a hex nut 26 (FIGS. 6 and 7) having a particular size. A multi-piece set 30 (FIG. 9A) of nut drivers 1 may be fabricated with socket openings 11 having various sizes to receive nuts 26 of corresponding sizes. For example and without limitation, in some embodiments, the socket openings 11 of the nut drivers 1 in a nut driver set 30 may be fabricated with standard English sizes expressed in fractions of an inch: 3/16", 1/4", 5/16", 11/32", 3/8", 7/16" and 1/2", respectively. The nut driver shank 8 of the nut drivers 1 in each nut driver set 30 may have a standard length of 3 inches (76 mm) or 6 inches (152 mm). Alternatively, the nut drivers 1 in the English unit embodiments of the nut driver set 30 may have other shank lengths. In other embodiments, the socket openings 11 of the nut drivers 1 in a nut driver set 30 may be fabricated with standard metric sizes expressed in millimeters: 5 mm, 5.5 mm, 6 mm, 7 mm, 8 mm, 9 mm and 10 mm, respectively. The nut drivers 1 in the metric embodiments of the nut driver set 30 may each have a standard shank length of 3 inches. Alternatively, the nut drivers 1 in the metric unit embodiments of the nut driver set 30 may have other shank lengths.

The handles 2 of the nut drivers 1 in each multi-piece nut driver set 30 may be color-coded according to the size of the socket opening 11 of each nut driver 1. The color-coding scheme which relates the size of the socket opening 11 to the color of the handle 2 of each nut driver 1 may be a standard or conventional color-coding scheme. Accordingly, in some English unit embodiments, the nut driver 1I having a socket opening 11 with a size of 3/16" may have a black handle 2; the nut driver 1 with a 1/4" socket opening 11 may have a red handle 2; the nut driver 1 with a 5/16" socket opening 11 may have a yellow handle 2; the nut driver 1 with a 11/32" socket opening 11 may have a green handle 2; the nut driver 1 with a 3/8" socket opening 11 may have a blue handle 2; the nut driver 1 with a 7/16" socket opening 11 may have a brown handle 2; and the nut driver 1 with a 1/2" socket opening 11 may have a red handle 2. In other English unit embodiments, the color-coding scheme which relates the size of the socket opening 11 to the color of the handle 2 of each nut driver 1 may vary from the foregoing description.

In some metric unit embodiments of the nut driver set 30, the nut driver 1 having a 5 mm socket opening 11 may have a black handle 2; the nut driver 1 having a 5.5 mm socket opening 11 may have a brown handle 2; the nut driver 1 having a 6 mm socket opening 11 may have a red handle 2; the nut driver 1 having a 7 mm socket opening 11 may have an orange handle 2; the nut driver 1 with an 8 mm socket opening 11 may have a yellow handle 2; the nut driver 1 with a 9 mm socket opening 11 may have a green handle 2; and the nut driver 1 with a 10 mm socket opening 11 may have a blue handle 2. In other metric unit embodiments of the nut driver set 30, the color-coding scheme which relates the size of the socket opening 11 to the color of the handle 2 of each nut driver 1 may vary from the foregoing description. In the various embodiments of the nut driver 1, the colored portion or portions of the nut driver handle 2 of each nut driver 1 may include the handle grip ridges 3, the finger recess 4 and/or any other portion of the nut driver handle 2, the nut driver shank 8 and/or the nut driver socket 10.

Multiple colored nut selection strips 14 may be provided on the nut driver shank 8 of each nut driver 1. In some embodiments, the nut selection strips 14 may be grooves which are cut, casted or otherwise fabricated into the nut driver shank 8 according to the knowledge of those skilled in the art and then painted or otherwise colored. In other embodiments, the nut selection strips 14 may be strips of paint or other colored material which is applied to the nut driver shank 8 of each nut driver 1. In stilt other embodiments, the nut selection strips 14 may be pieces of painted or otherwise colored metal, plastic or other material which are attached to the surface of the nut driver shank 8 according to the knowledge of those skilled in the art.

Figure 2:
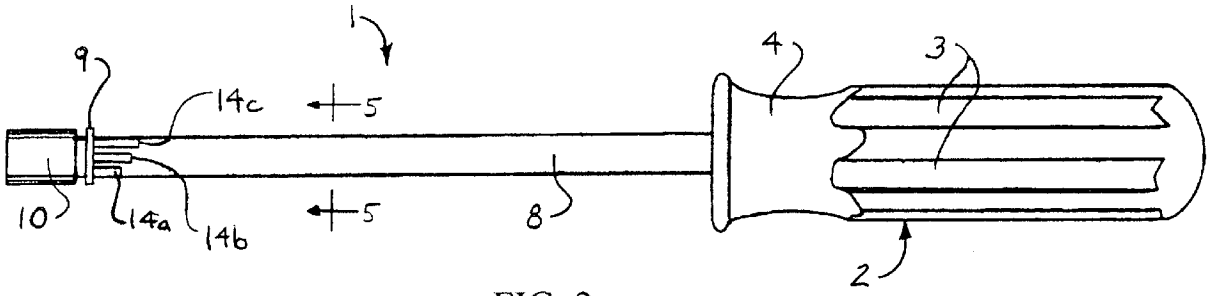
FIG. 2 is a side view of an illustrative embodiment of the nut driver with nut selecting capability, with a first portion of the nut selection strips visible on the shank of the nut driver.
Figure 3:
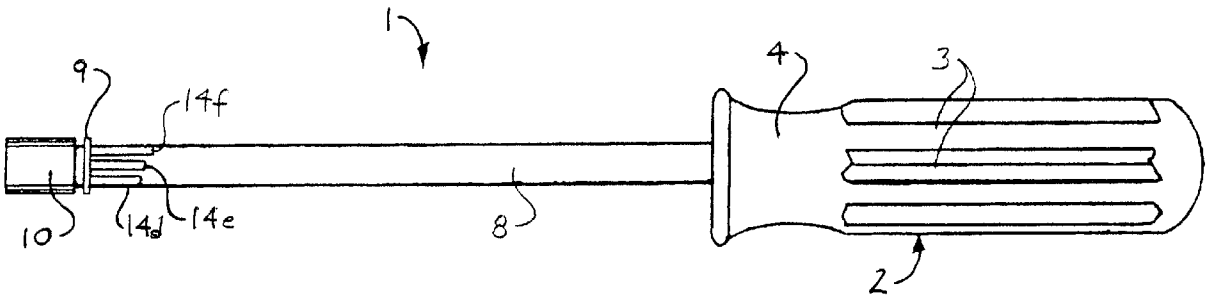
FIG. 3 is a side view of an illustrative embodiment of the nut driver with nut selecting capability, with the nut driver rotated 180 degrees relative to the position in FIG. 2 and a second portion of the nut selection strips visible on the shank of the nut driver.
Figure 4:
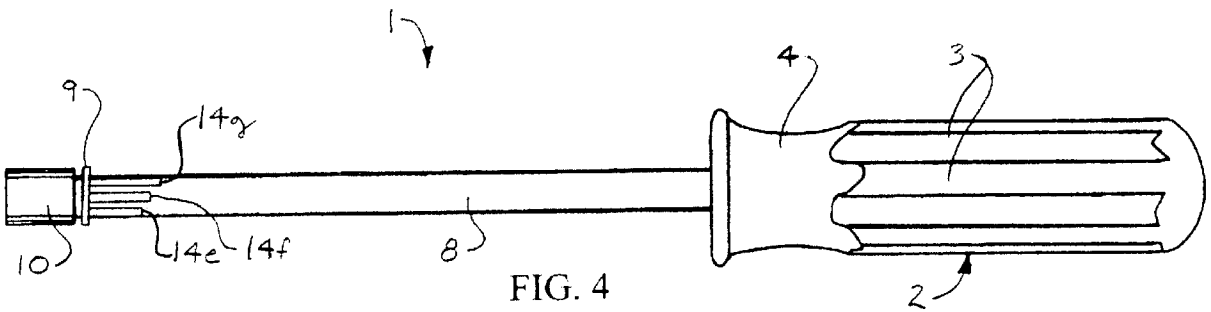
FIG. 4 is a side view of an illustrative embodiment of the nut driver with nut selecting capability, with the nut driver rotated to a third position and an additional portion of the nut selection strips visible on the shank of the nut driver.
Figure 5:
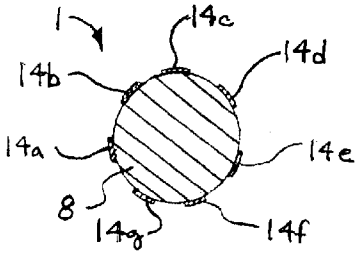
FIG. 5 is a cross-sectional view, taken along section lines 5-5 in FIG. 2.

As illustrated in FIG. 5, the nut selection strips 14 may extend in generally parallel, spaced-apart relationship with respect to each other around the circumference of and in generally parallel relationship to a longitudinal axis of the nut driver shank 8. The colors of the nut selection strips 14 on the nut driver shank 8 of each rut driver 1 in a nut driver set 30 may correspond to the colors of the nut driver handles 2 of the respective nut drivers 1 in the nut driver set 30. Moreover, the length of each nut selection strip 14 may substantially equal the size or width of the nut 26 which corresponds to the nut driver 1 having the nut driver handle 2 with the same color as that nut selection strip 14. For example, as illustrated in FIGS. 2-4, in some English unit embodiments, the nut selection strips 14 may include a black first nut selection strip 14*a* having a length of 3/16" (corresponding to the nut driver 1 having a socket opening 11 with a size of 3/16" and a black nut driver handle 2); a red second nut selection strip 14*b* having a length of 1/4"; a yellow third nut selection strip 14*c* having a length of 5/16"; a green fourth nut selection strip 14*d* having a length of 11/32"; a blue fifth nut selection strip 14*e* having a length of 3/8"; a brown sixth nut selection strip 14*f* having a length of 7/16"; and a red seventh nut selection strip 14*g* having a length of 1/2". In some metric unit embodiments, the nut selection strips 14 may include a black first nut selection strip 14*a* having a length of 5 mm (corresponding to the nut driver 1 having a socket opening 11 with a size of 5 mm and a black nut driver handle 2); a brown second nut selection strip 14*b* having a length of 5.5 mm; a red third nut selection strip 14*c* having a length of 6 mm; an orange fourth nut selection strip 14*d* having a length of 7 mm; a yellow fifth nut selection strip 14*e* having a length of 8 mm; a green sixth nut selection strip 14*f* having a length of 9 mm; and a blue seventh nut selection strip 14*g* having a length of 10 mm. In some embodiments, the nut selection strips 114 may be ordered around the circumference of the nut driver shank 8 (FIG. 5) according to successively increasing length of the nut selection strips 14.

As further illustrated in FIGS. 2-4, in some embodiments, a shank flange 9 may be provided on the nut driver shank 8 of each nut driver 1. The shank flange 9 may be generally adjacent to the nut driver socket 10. The nut selection strips 14 may extend along the nut driver shank 8 from the shank flange 9 toward the nut driver handle 2. In other embodiments, the shank flange 9 and the nut selection strips 14 may be placed at any location along the length of the nut driver shank 8.

Referring next to FIGS. 6-9A of the drawings, in exemplary application, multiple nut drivers 1 may be available in a multi-piece nut driver set 30. In some applications, the nut driver set 30 may include seven nut drivers 1, as illustrated. In other applications, the nut driver set 30 may include a greater or lesser number of nut drivers 1. In some applications, the respective nut drivers 1 in the nut driver set 30 may be sized to drive nuts 26 having various sizes expressed in English units (fractions of an inch) as was described herein above. Accordingly, in some applications, the nut driver set 30 may include a first nut driver 1 having a black nut driver handle 2 and a 3/16" socket opening 11; a second nut driver 1 having a red nut driver handle 2 and a 1/4" socket opening 11; a third nut driver 1 having a yellow nut driver handle 2 and a 5/16" socket opening 11; a fourth nut driver 1 having a green nut driver handle 2 and a 11/32" socket opening 11; a fifth nut driver 1 having a blue nut driver handle 2 and a 3/8" socket opening 11; a sixth nut driver 1 having a brown nut driver handle 2 and a 7/16" socket opening 11; and a seventh nut driver 1 having a red nut driver handle 2 and a 1/2" socket opening 11. Each nut driver 1 in the English unit nut driver set 30 may have a standard shank length of 3 inches or 6 inches or may have an alternative length. In other applications, the nut drivers 1 in the nut driver set 30 may be sized to drive nuts 26 having sizes expressed in metric units (millimeters) as was described herein above. Accordingly, the nut driver set 30 may include a first nut driver 1 having a black nut driver handle 2 and a 5 mm socket opening 11; a second nut driver 1 having a brown nut driver handle 2 and a 5.5 mm socket opening 11; a third nut driver 1 having a red nut driver handle 2 and a 6 mm socket opening 11; a fourth nut driver 1 having an orange nut driver handle 2 and a 7 mm socket opening 11; a fifth nut driver 1 having a yellow nut driver handle 2 and a 8 mm socket opening 11; a sixth nut driver 1 having a green nut driver handle 2 and a 9 mm socket opening 11; and a seventh nut driver 1 having a blue nut driver handle 2 and a 10 mm socket opening 11. Each nut driver 1 in the metric unit nut driver set 30 may have a standard shank length of 3 inches or may have an alternative length.

Figure 6:
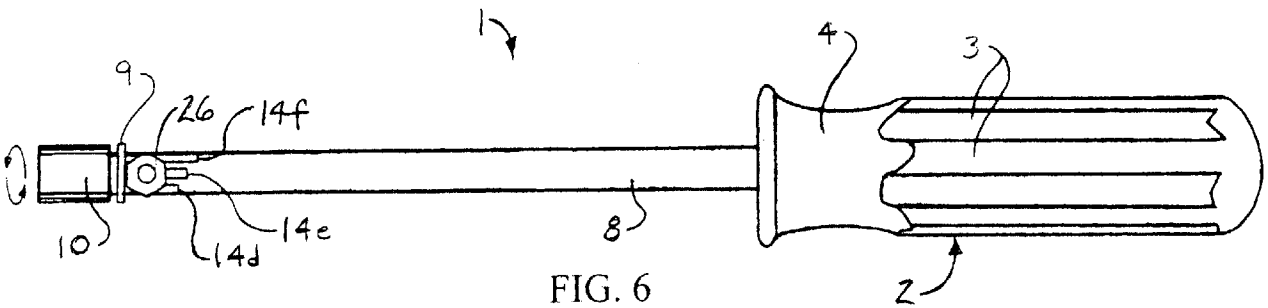
FIG. 6 is a side view of an illustrative embodiment of the nut driver with nut selecting capability, with a nut placed on a first portion of the nut selection strips in matching of the nut with one of the nut selection strips.
Figure 7:
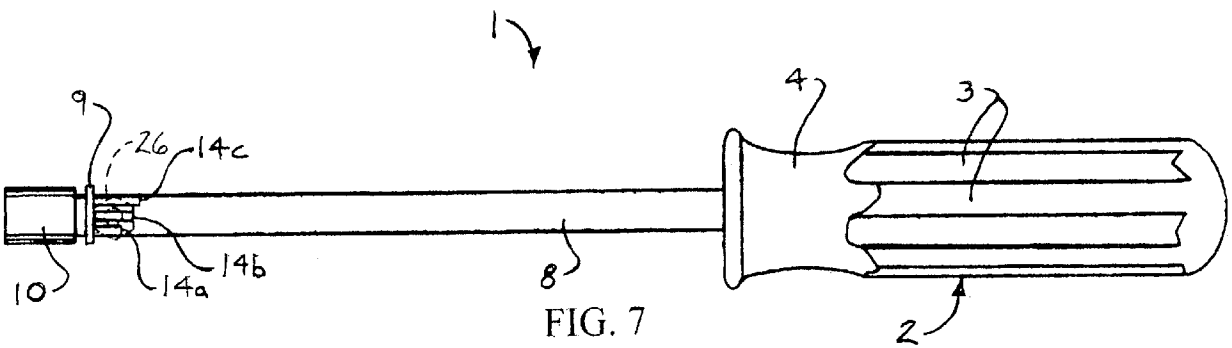
FIG. 7 is a side view of the nut driver with nut selecting capability rotated 180 degrees relative to the position illustrated in FIG. 6, with the nut (illustrated in phantom) matched with a nut selection strip having a length which corresponds to the width of the nut.
Figure 8:
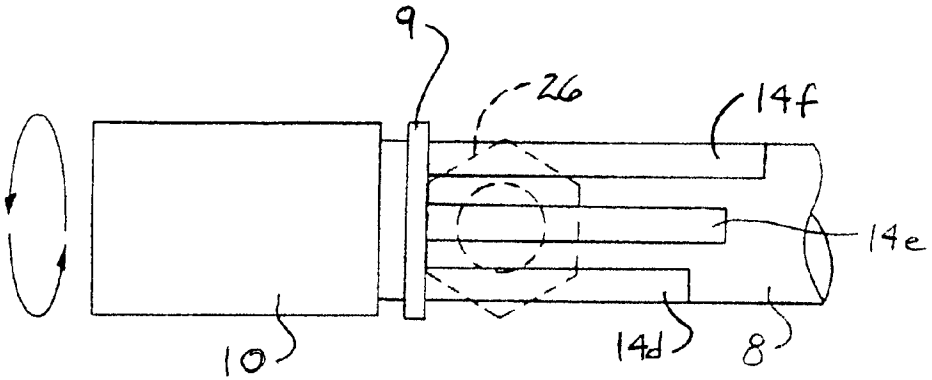
FIG. 8 is a sectional view of the shank of an illustrative embodiment of the nut driver with nut selecting capability, with a nut (illustrated in phantom) placed on a first portion of the nut selection strips in matching of the nut with one of the nut selection strips as illustrated in FIG. 6.
Figure 9:
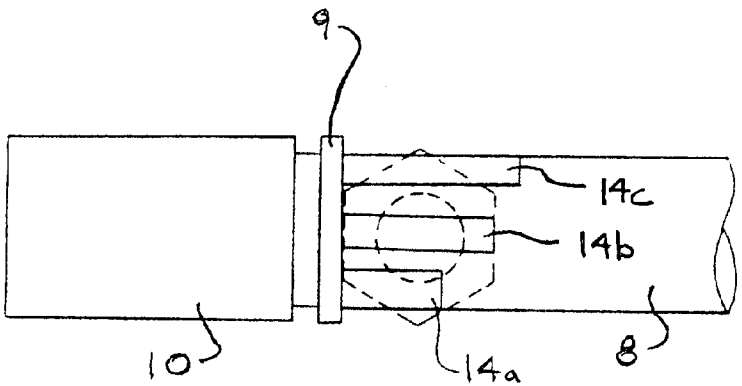
FIG. 9 is a sectional view of the shank of an illustrative embodiment of the nut driver with nut selecting capability, with the nut (illustrated in phantom) matched with a nut selection strip having a length which corresponds to the width of the nut as illustrated in FIG. 7.
Figure 9A:
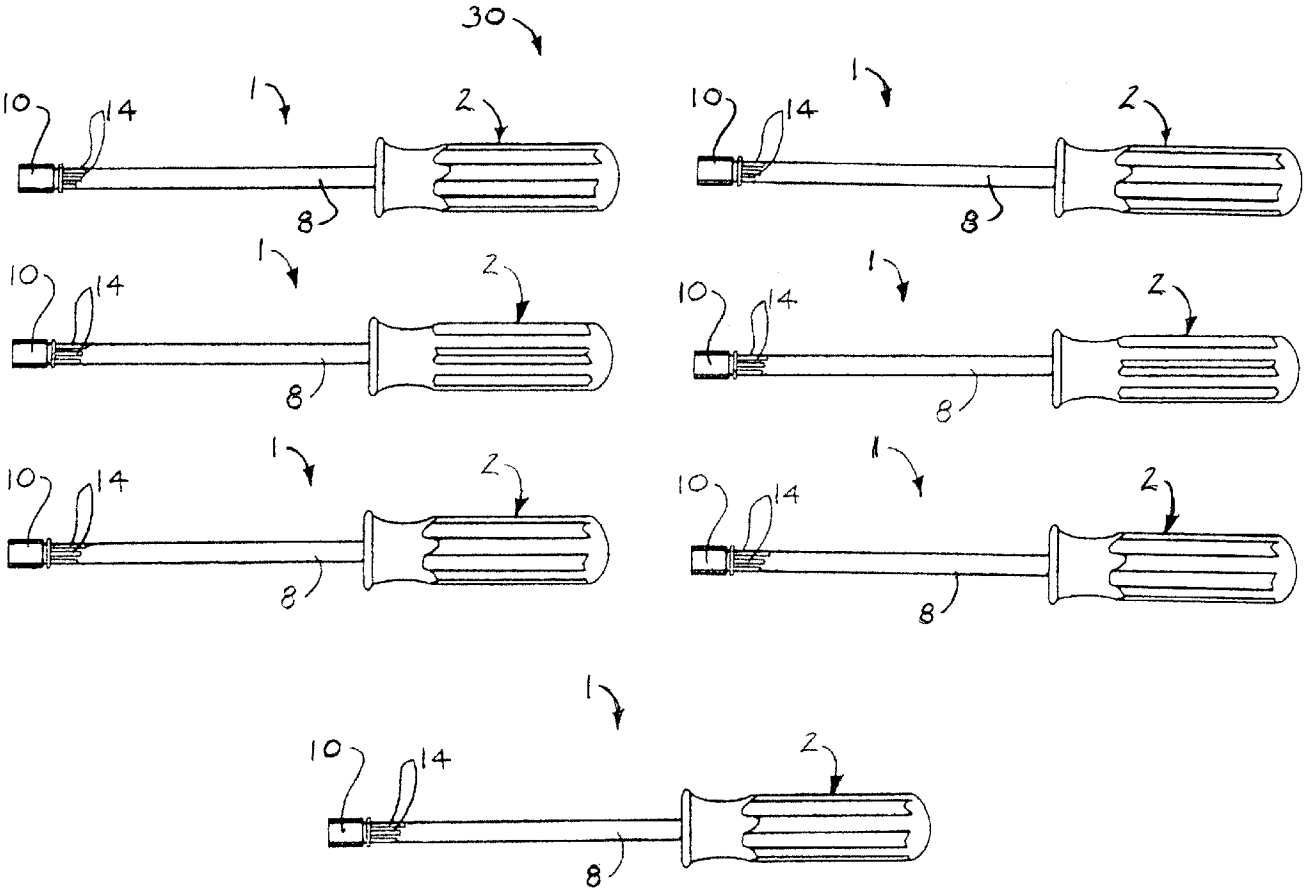
FIG. 9A is a nut driver set which includes multiple nut drivers according to an illustrative embodiment of the disclosure.

For a particular application, a nut 26 having a particular size must be selected for threading on a bolt (not illustrated) having a size which is compatible with the size of the nut 26. In the event that the size of the nut 26 which is to be used in the application is known (such as by examining the bolt on which the nut 26 is to be threaded or in some other manner), but the nut 26 having that size has not been identified from among a supply of nuts 26 of various sizes, the nut driver 1 which is to be used to drive the nut 26 on the bolt can be selected from among the nut drivers 1 in the nut driver set 30 on the basis of the colors of the nut driver handles 2. For example, in the event that a 5/16" nut 26 is to be threaded on the bolt, the nut driver 1 having a yellow nut driver handle 2 is selected since the nut driver 1 with the yellow nut driver handle 2 is known by the standard color-coding scheme to have a 5/16" socket opening 11. A nut 26 is then selected from a supply of nuts 26 which may have a mixture of sizes. As illustrated in FIGS. 6 and 8, the selected nut 26 is initially placed against the nut selection strips 14 with a flat surface of the nut 26 in abutment with the shank flange 9. Next, the nut driver shank 8 of the nut driver 1 may be rotated until the length of one of the nut selection strips 14 matches the width (as measured from one flat surface to an opposite flat surface) of the selected nut 26. As illustrated in FIGS. 7 and 9, the width of the selected nut 26 (illustrated in phantom) matches the length of the second nut selection strip 14*b*, which is red. Therefore, the red second nut selection strip 14*b* indicates (by the standard color-coding, scheme) that the selected nut 26 is a 1/4" nut 26 and is thus the incorrect size for the application. The first selected 1/4" nut 26 is replaced with a second selected nut 26 from the supply of nuts 26 and the second nut 26 is placed against the nut selection strips 14 and in abutment with the shank flange 9 in a similar manner as the first selected nut 26. The nut driver shank 8 of the nut driver 1 is rotated until the length of one of the nut selection strips 14 matches the width of the second selected nut 26. In the event that the width of the second selected nut 26 matches the length of the yellow third nut selection strip 14*c*, the second selected nut 26 is used for the application since the yellow color of the third nut selection strip 14*c* matches the yellow nut driver handle 2 of the nut driver 1 which was selected for the application. If on the other hand the width of the second selected nut 26 does not match the length of the yellow third nut selection strip 14*c*, the second selected nut 26 is replaced with a third nut 26 and the procedure is completed until a nut 26 having the same width as the yellow third nut selection strip 14*c*, and thus, the correct size for the application, is identified. The same procedure may be carried out in selection of a nut 26 for use with nut drivers 1 which are sized in metric units (mm).

Figure 10:
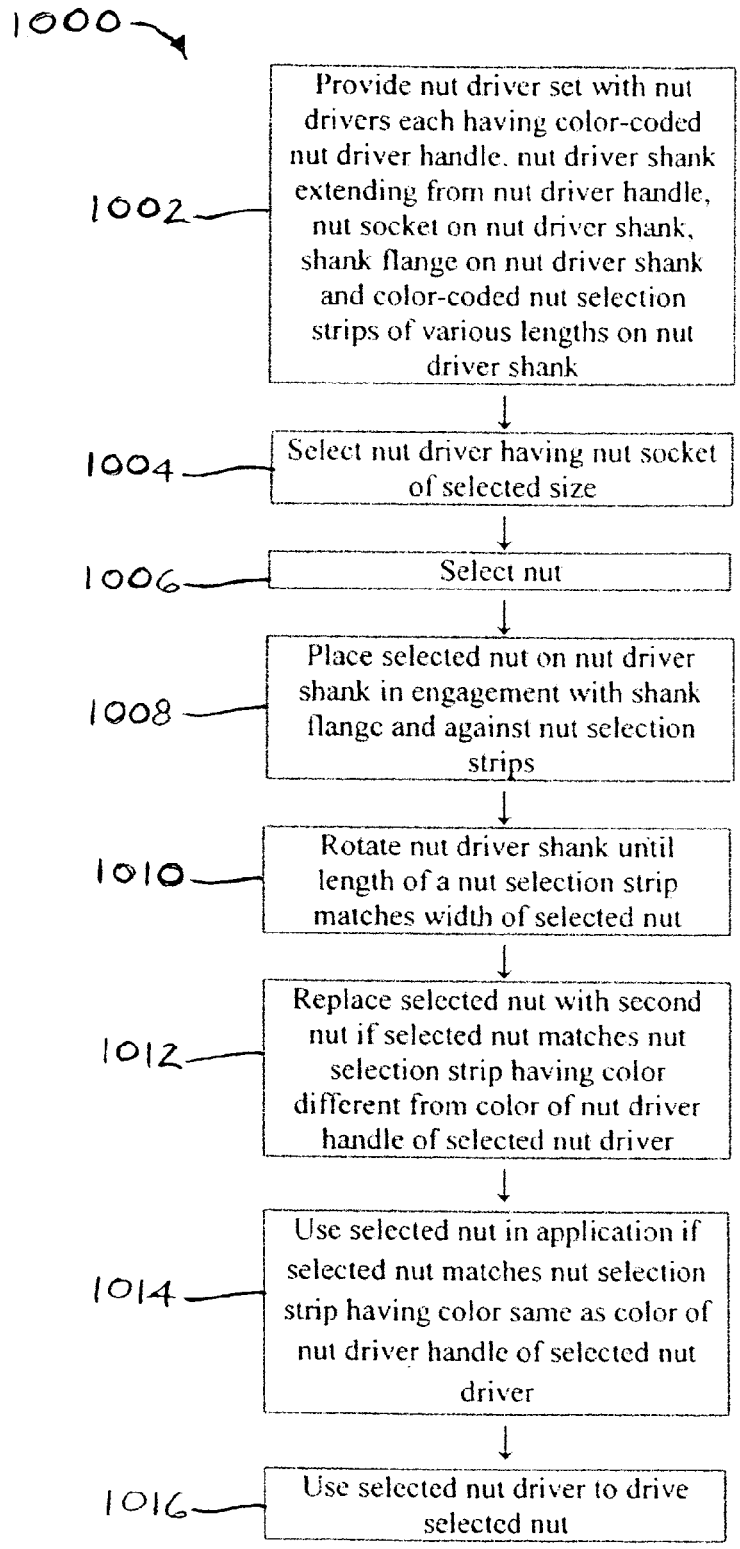
FIG. 10 is a flow diagram of an illustrative embodiment of a method of matching a nut with a nut driver having a corresponding size.

Referring next to FIG. 10 of the drawings, a flow diagram 1000 of an illustrative embodiment of a method of matching a nut with a nut driver having a corresponding size is illustrated. In block 1002, a nut driver having a color-coded nut driver handle, a nut driver shank extending from the nut driver handle, a nut socket on the nut driver shank, a shank flange on the nut driver shank and color-coded nut selection strips of various lengths on the nut driver shank is provided. In block 1004, a nut driver having a nut socket of selected size is selected. In block 1006, a nut is selected. In block 1008, the selected nut is placed on the nut driver shank in engagement with the shank flange and against the nut selection strips. In block 1010, the nut driver shank is rotated until the length of one of the nut selection strips matches the width of the selected nut. In block 1012, the selected nut is replaced with a second nut if the selected nut matches a nut selection strip having a color which is different from the color of the nut driver handle of the selected nut driver. In block 1014, the selected nut is used in the application if the selected nut matches the nut selection strip having a color which is the same as the color of the nut dr handle of the selected nut driver. In block 1016, the selected nut driver is used to drive the selected nut.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A nut driver, comprising:

a nut driver handle;

a nut driver shank extending from the nut driver handle;

a nut driver socket having a socket opening on the nut driver shank;

at least a portion of at least one of the nut driver handle, the nut driver shank and the nut driver socket having one of a plurality of colors;

a plurality of colored nut selection strips having a plurality of lengths, respectively, on the nut driver shank, one of the nut selection strips having the same color as the at least a portion of at least one of the nut driver handle, the nut driver shank and the nut driver socket; and wherein the plurality of lengths, respectively, of the plurality of colored nut selection strips corresponds to a plurality of nut sizes, respectively.

2. The nut driver of claim 1 wherein the plurality of lengths, respectively, of the plurality of colored nut selection strips comprises lengths of 3/16", 1/4", 5/16", 11/32", 3/8", 7/16" and 1/2", respectively.

3. The nut driver of claim 1 wherein the plurality of lengths, respectively, of the plurality of colored nut selection strips comprises lengths of 5 mm, 5.5 mm, 6 mm, 7 mm, 8 mm, 9 mm and 10 mm, respectively.

4. The nut driver of claim 1 wherein the one of a plurality of colors is black, red, yellow, green, blue, brown or red.

5. The nut driver of claim 1 wherein the one of a plurality of colors is black, brown, red, orange, yellow, green and blue.

6. The nut driver of claim 1 wherein the nut selection strips are ordered around a circumference of the nut driver shank according to successively increasing lengths of the nut selection strips.

7. The nut driver of claim 1 further comprising a shank flange on the nut driver shank and wherein the nut selection strips extend from the shank flange along the nut driver shank.

8. The nut driver of claim 7 wherein the shank flange is adjacent to the nut driver socket.

9. A nut driver set, comprising:

a plurality of nut drivers each including:

a nut driver handle;

a nut driver shank extending from the nut driver handle;

a nut driver socket having a socket opening on the nut driver shank;

at least a portion of at least one of the nut driver handle, the nut driver shank and the nut driver socket having one of a plurality of colors, respectively, corresponding to the plurality nut drivers, respectively;

a plurality of colored nut selection strips having a plurality of lengths, respectively, on the nut driver shank, one of the nut selection strips having the same color as the at least a portion of at least one of the nut driver handle, the nut driver shank and the nut driver socket; and wherein the plurality of lengths, respectively, of the plurality of colored nut selection strips corresponds to a plurality of nut sizes, respectively; and wherein the one of a plurality of colors of the at least a portion of at least one of the nut driver handle, the nut driver shank and the nut driver socket corresponds to a plurality of colors of the plurality of colored nut selection strips, respectively.

10. The nut driver set of claim 9 wherein the plurality of lengths, respectively, of the plurality of colored nut selection strips comprises lengths of 3/16", 1/4", 5/16", 11/32", 3/8", 7/16" and 1/2", respectively.

11. The nut driver set of claim 9 wherein the plurality of lengths, respectively, of the plurality of colored nut selection strips comprises lengths of 5 mm, 5.5 mm, 6 mm, 7 mm, 8 mm, 9 mm and 10 mm, respectively.

12. The nut driver set of claim 9 wherein the one of a plurality of colors is black, red, yellow, green, blue, brown or red.

13. The nut driver of claim 9 wherein the one of a plurality of colors is black, brown, red, orange, yellow, green and blue.

14. The nut driver of claim 9 wherein the nut selection strips are ordered around a circumference of the nut driver shank according to successively increasing lengths of the nut selection strips.

15. The nut driver of claim 9 further comprising a shank flange on the nut driver shank and wherein the nut selection strips extend from the shank flange along the nut driver shank.

16. The nut driver of claim 15 wherein the shank flange is adjacent to the nut driver socket.

17. A method of matching a nut with a nut driver having a corresponding size, comprising:

providing a nut driver including a color-coded nut driver handle, a nut driver shank extending from the nut driver handle, a nut socket on the nut driver shank and color-coded nut selection strips of various lengths on the nut driver shank;

selecting a nut;

placing the selected nut on the nut driver shank of the nut driver against the nut selection strips; and rotating the nut driver shank of the nut driver until the length of one of the nut selection strips matches a width of the selected nut.

18. The method of claim 17 further comprising providing a shank flange on the nut driver shank and wherein placing the nut on the nut driver shank of the nut driver against the nut selection strips comprises placing the nut in engagement with the shank flange.

19. The method of claim 17 further comprising replacing the nut with a second nut if the nut matches the length of one of the nut selection strips having a color different from the color of the nut driver handle of the nut driver.

20. The method of claim 17 further comprising using the nut in an application if the nut matches the length of one of the nut selection strips having a color the same as the color of the nut driver handle of the nut driver.

* * * * *